US006045313A

United States Patent [19]

Wu

[11] Patent Number: 6,045,313

[45] Date of Patent: Apr. 4, 2000

[54] APPARATUS AND METHOD FOR SEAMING CONTAINERS

[75] Inventor: Samuel C. Wu, Lakewood, Colo.

[73] Assignee: Edge Development, L.L.C., Golden, Colo.

[21] Appl. No.: 09/088,268

[22] Filed: Jun. 1, 1998

[51] Int. Cl.[7] ..... B21D 51/26

[52] U.S. Cl. ..... 413/6; 413/27; 413/52

[58] Field of Search ..... 413/6, 4, 30, 27, 413/26, 52, 45

[56] References Cited

U.S. PATENT DOCUMENTS

| | | | |
|---|---|---|---|
| 1,715,352 | 6/1929 | Chalmers | 413/52 |
| 3,730,118 | 5/1973 | Del-Frate | 413/30 |
| 3,742,883 | 7/1973 | Costanzo . | |
| 3,835,799 | 9/1974 | Huth et al. | 413/27 |
| 4,152,997 | 5/1979 | Webster . | |
| 5,014,491 | 5/1991 | Tsukada et al. | 413/6 X |
| 5,125,208 | 6/1992 | Tsukada et al. | 413/6 X |
| 5,353,619 | 10/1994 | Chu et al. | 72/121 |
| 5,533,853 | 7/1996 | Wu | 413/31 |

FOREIGN PATENT DOCUMENTS

| | | |
|---|---|---|
| 6418540 | 1/1989 | Japan . |
| 2144230 | 12/1990 | Japan . |

*Primary Examiner*—James F. Coan

*Attorney, Agent, or Firm*—Timothy J. Martin; Michael R. Henson; Mark H. Weygandt

[57] ABSTRACT

A method and apparatus for seaming a lid onto a container body by moving the body with a lid placed thereon in a linear fashion by allowing free rotation of the conveyed container body and lid against a linear seaming element is disclosed.

22 Claims, 5 Drawing Sheets

APPARATUS AND METHOD FOR SEAMING CONTAINERS

FIELD OF THE INVENTION

The present invention broadly concerns the packaging of products in containers. More particularly, though, the present invention is directed to the seaming of a container end closure onto a container body after the product is placed therein. This invention has special applicability to the seaming of a lid onto a container body wherein the product is either a liquid or contains liquid.

BACKGROUND OF THE INVENTION

The packaging of a variety of goods for transport and storage has always been a need for industrialized countries. While a wide variety of packaging techniques are available, of particular interest to industry is the packaging of products in small unit containers, such as metal cans. Here, the product to be packaged is placed in a container body, and a lid is then secured onto the container body to retain the product in the container and to prevent contamination of the product from the external environment.

Of particular interest to the industry and to the scope of the present invention is the metal container industry wherein a product is placed in a metallic container body onto which a lid is subsequently seamed. Such containers are often used in the food and beverage industry. Here, steel or aluminum lids are respectively seamed onto the top edge of a filled container. Typically, such lids may have pull tabs or other opening structures fabricated therein to allow easy manual opening of the container. Examples of such containers are aluminum beverage cans which predominant the packaging of beverages at the present time. Another example of such containers are those to hold liquid petroleum products, such as oil, engine additives, brake fluids, etc. Thus, it is typical to package liquid products in such containers.

A commonly used seaming apparatus utilizes a turret including a plurality of seaming stations. An unseamed container and a lid are placed in a seaming station, and a lid is engaged by a chuck which places a column load between the container body and the lid with the lid engaging the top peripheral edge of the container body. The chuck is connected to a gear drive which operates to rotate the container and lid. A first seaming roller engages the top edge of the container body and the outer peripheral edge of the lid with the first seaming roller and the chuck contoured to cooperate together thereby to change the shape of the lid and can edge as it is driven around the seaming station. Next, the first seaming roller is withdrawn, and a second seaming roller is toggled into position. The container continues to rotate in the seaming station to complete the seaming operation. Here, the peripheral edge of the lid and the top edge of the can are sequentially configured by the chuck acting with the first and second seaming rollers to form a final seam that typically hermetically seals the contents of the container from the external environment.

Existing seaming apparatus, however, are not without disadvantages. Usually, the structure of such a seaming apparatus is fairly complex, incorporating a large number of both stationary and moving parts. As a result of the large number of moving parts, a first problem relates to lubrication. Here, oil must be provided on a regular basis to reduce friction of the moving parts. The presence of oil in such quantities, though, is undesirable where the product to be packaged may become inadvertently contaminated with the lubricating fluid. Such is an especial disadvantage for the product packaged is a food or beverage for consumption.

Moreover, the use of a complex structure, including such structures as rotary tables, can lifters, the turret head chuck assemblies, the gear drives, knock-out rods, and the like require a typical can seamer to be a fairly expensive and massive structure. This is especially true where a sufficient number of seaming stations are provided to get a rapid throughput of containers during the seaming operation. The size and complexity of such machines increase their capital costs which make the cost prohibitive for small canners and packagers.

A further disadvantage, and one exacerbated by the complexity of such machinery, is that the malfunction of even one small part can result in substantial downtime of the seaming apparatus. Delays in the repair and maintenance of such machinery causes loss of production. This, along with the cost of the many parts, results in added overhead when such lid seamers are used in production operations.

In addition to the capital and overhead costs associated with the acquisition and maintenance of such machines, there is a further cost where a liquid product is to be packaged. Since the seaming stations are arranged in a circle, when a filled container is transferred to a seaming station, the substantial forces resulting from centripetal acceleration are present such that spillage of the product becomes problematic. Indeed, in beverage operations, it is not unusual to loose approximately three percent (3%) of the product to spillage during the seaming operation.

Due to the inherent design of such seamers, they exert a high column loading on the containers in order to maintain the containers upright and spinning with the lids pressed thereon during the seaming operation. However, such high column loading is undesirable with an increasing trend towards thinner walled aluminum containers that are employed to reduce material's cost. Such high column loading coupled with thin walled containers can result in undue compression and collapse of the container body during the seaming operation.

Accordingly, a need remains for improved seaming apparatus and methods to attach lids onto container bodies. There is a need for such apparatus to be lower in capitol costs as well as having lower costs of installation, maintenance and use. There are further needs to reduce product loss during, to allow seaming of thin walled containers and to provide more efficient seaming apparatus and methods which can be employed by small volume packagers.

SUMMARY OF THE INVENTION

It is an object of the present invention to provide a new and useful seaming apparatus and method that can efficiently seam an end closure, such as a lid, onto a container body either as part of container fabrication or after a container body is filled with a product to be packaged, especially where such product is in a liquid form or contains a substantial amount of liquid.

It is another object of the present invention to provide a compact seaming apparatus employing a reduced number of parts so as to be lower in cost to purchase, install, operate and maintain.

Another object of the present invention is to provide a seaming apparatus that is more modular in construction so that multiple stations can be placed in parallel installation thus allowing customization to the packaging volume required by the user.

It is still a further object of the present invention to provide a seaming apparatus wherein the container bodies move in a linear fashion during the seaming operation thereby to reduce spillage of the contents therefrom.

Yet another object of the present invention is to produce a seaming apparatus employing a method that reduces the need for applying high column loading on the container body.

According to the present invention, then, a seamer apparatus is adapted to receive a container body and an end closure, such as a lid, therefor at an upstream end and is operative to seam a peripheral edge of the end closure onto a first end edge of the container body thereby to form a seamed container. The seaming operation takes places as the end closure and the container body move from an upstream end to a downstream end.

Broadly, the seaming apparatus has a movable container support that includes a freely rotatable turntable. The container support is operative to rotatably support the container body during transport. A movable end closure support is provided, and the closure support includes a freely rotatable chuck that is operative to engage and support the end closure on the first end edge of the container body with the end closure and the container body thereby defining an unseamed set. A transport includes a pair of loop conveyors each having an advance section, a downstream reverse section, a return section and an upstream reverse section. The advance sections of the two conveyors are in opposed facing relationship to one another with the first conveyor being operative to transport the container support in a transport direction that is linear along the advance section thereof from the upstream end toward the downstream end. The second conveyor is operative to transport the end closure support in the transport direction. A seaming element is then disposed alongside the advance sections of the two conveyors. This seaming element is elongated and has a seaming groove formed thereon that is operative in cooperation with the chuck to engage the peripheral edge of the end closure and the first end edge of the container body. Such engagement rotates the unseamed set as it is transported along the seaming element. The seaming groove an the chuck are configured to seam the first end edge and the peripheral edge together to form the seamed container as the unseamed set is advanced linearly along the seaming element. A container drive is then operative to drive the first and second conveyors.

In greater detail, the seamer apparatus is structured so that the end closure is placed on the chuck when the end closure support travels along the return section of the second conveyor. Here, the seamer apparatus includes a guide that is operative to retain the end closure on the chuck while the end closure support travels along the upstream reverse section of the second conveyor. This guide is preferably an arcuate member having at least 180° of arc. Preferably, the arcuate member is semi-circular in shape. It is provided with a T-shaped channel formed therein with the T-shaped channel being sized and adapted to slidably receive and support an unseamed end closure.

Each of the conveyors preferably includes a pair of chains with the chain of each pair being in spaced apart relation to one another. The container support is mounted between and supported by a first pair of chains while the end closure support is mounted between and supported by a second pair of chains. A mechanical linkage is associated with the first and second conveyors so as to drive the first and second conveyors synchronously such that the container support and the end closure support are in facing relation during travel along the respective advance sections of the first and second conveyors.

Preferably, there are a plurality of container supports and a plurality of end closure supports. Each container support is in the form of a first carriage that has a first bed and a plurality of first wheels disposed thereon. Likewise, the end closure support is in the form of a second carriage that includes a second bed and a plurality of second wheels disposed thereon. A first trackway is provided and is engaged by the first wheels during the advancement of the first carriage from the upstream end toward the downstream end. A second trackway is provided and is engaged by the second wheels during advancement from the upstream end toward the downstream end. In this manner, the first and second beds, and thus the end closure and the container body, are rigidly supported against movement away from one another during travel of the unseamed set along the seaming element. The first trackway includes a pair of opposed first rails each having a first race formed thereon. Likewise, the second trackway includes a pair of opposed second rails which each have a second race formed therein. The turntable on the container support is rotatably journaled along an axis perpendicular to the bed of the first carriage and is preferably resiliently biased towards the second carriage while they are alongside the seaming element. The amount of biasing force is preferably adjustable. This biasing may be accomplished by a compression spring, and the adjustment may be provided by a screw and movable plate that pre-compresses the spring a desired amount.

The seaming element is linear and the seaming groove may also be linear. Alternatively, the seaming groove can be a helical groove around a cylindrical seaming element. Where the seaming element is cylindrical in shape, a seaming element drive, such as a servo motor, may be used to operatively rotate the seaming element.

An end closure feed assembly may be provided to sequentially place unseamed end closures on the end closure supports as they are transported around the second conveyor. Likewise, a container body feed assembly may be provided to sequentially place container bodies on the container supports as they are transported around the first container. A container take-up assembly also may be provided to remove seamed containers from the transport.

Preferably, during transport, the container body is held in an upright position with the end closure being located at a top edge thereof. Here, the first conveyor forms a lower conveyor to support the container body while the second conveyor is a vertically upwardly spaced conveyor to carry the end closure support including the chuck.

The present invention also includes the method of seaming an end closure onto a container. This method includes the mechanical processing steps generally performed by the apparatus described above. More particularly, the method according to the present invention includes a first step of placing an end closure on a first end edge of a container body as an unseamed set. Next, the first end edge of the container and a peripheral edge of the end closure are engaged by a chuck. The method then includes the step of rigidly constraining the end closure and the container body against movement away from one another. Next, the method includes the step of rotatably supporting the unseamed set while constraining said end closure and said container body and while advancing the unseamed set in a linear direction from an upstream end toward a downstream end past a linear seaming element that has a longitudinal extended seaming groove disposed thereon such that the peripheral edge and the first end edge are engaged by the chuck and seaming groove. The method then includes the step of allowing rotation of the unseamed set as it is transported linear past the seaming element such that the chuck and seaming groove seam the end closure onto the container body as a seamed container. Finally, the method includes the step of discharging the seamed container at a downstream location.

These and other objects of the present invention will become more readily appreciated and understood from a consideration of the following detailed description of the exemplary embodiments when taken together with the accompanying drawings, in which:

DETAILED DESCRIPTION OF THE EXEMPLARY EMBODIMENTS

The present invention is directed to a seaming apparatus that is adapted to receive a container body and an unseamed end closure at an upstream portion thereof and thereafter convey the container body and the end closure as an unseamed set in a downstream direction. The seaming apparatus conveys the unseamed set in a linear fashion so that the end closure and container body are engaged in a linearly and longitudinally extending seaming element and a chuck which cooperate to seam the end closure and container body together thereby to seal the contents in the container body. As such, the present invention is also directed to a seaming apparatus system including the end closure feed, the container body feed as well as a container take-up assembly. Moreover, the present invention concerns a new and useful method for seaming containers.

In its broad form, the seamer apparatus according to the present invention includes several elements. A movable container support is provided to support the container body as it is transported from the upstream direction to the downstream direction, and a movable end closure support is provided to support an end closure on a first edge of the container body as it is transported from the upstream direction to the downstream direction. A transport is provided to convey the two movable supports so that the unseamed end closure and container body are moved linearly in the transport direction. The end closure support includes a chuck element, and a longitudinally extending seaming element having a longitudinally extending seaming groove is disposed so that, as the end closure and container body are conveyed in the downstream direction, the peripheral edge of the end closure and the upper edge of the container are engaged by the seaming element and the chuck thereby to rotate and seam the two separate pieces together as a seamed container.

Figure 1:
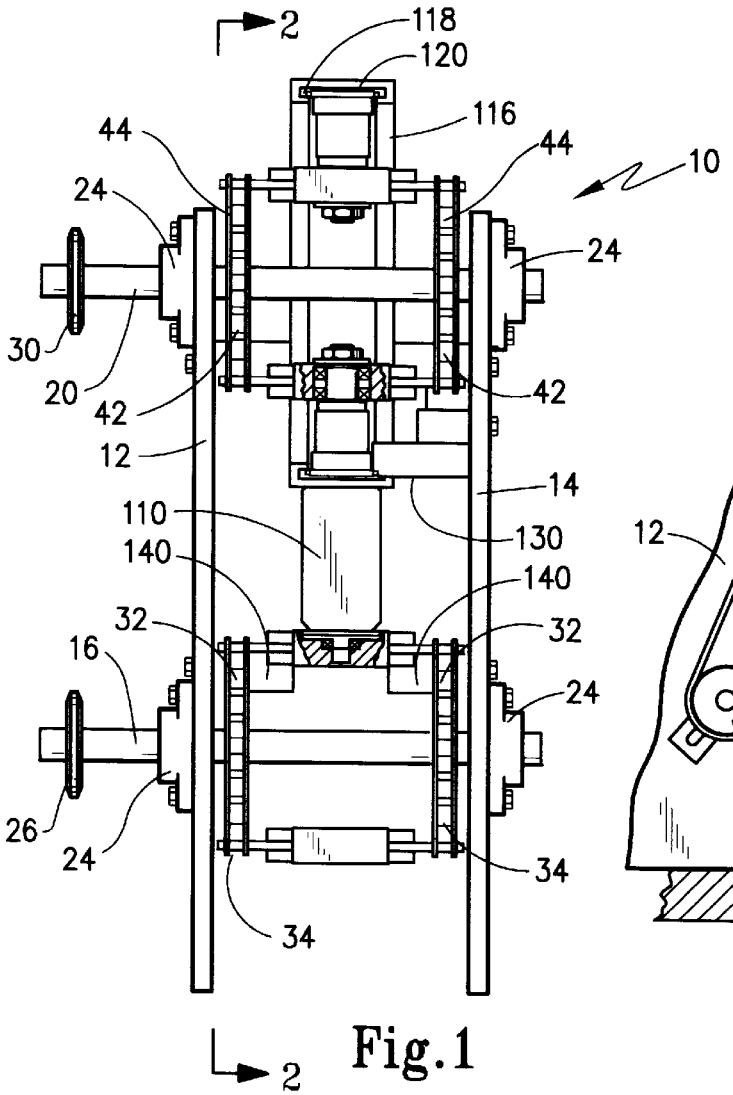
FIG. 1 is an end view in elevation of a seamer apparatus according to a first exemplary embodiment of the present invention and which incorporates the method of the present invention.
Figure 2:
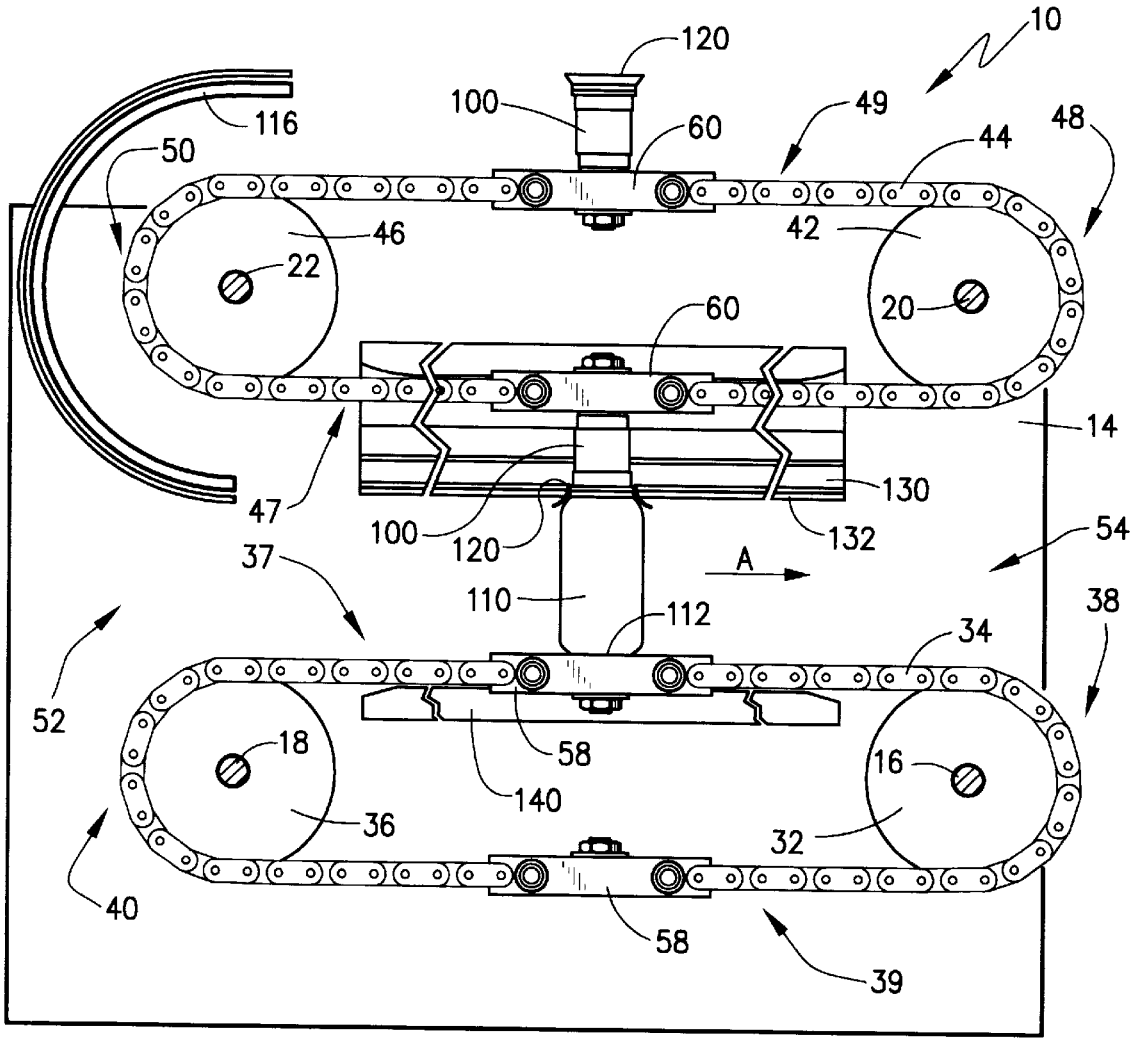
FIG. 2 is a cross-sectional view taken about lines 2—2 of FIG. 1.

A first exemplary embodiment of the present invention, then, is best shown in FIGS. 1 and 2. In these figures, it may be seen that seaming apparatus 10 includes a frame formed by a pair of side plates 12 and 14. Four rotatable axles, such as axles 16, 18, 20, and 22 are rotatably journaled transversely of side plates 12 and are supported by suitable bearings, such as bearings 24, for free rotation relative to side plates 12 and 14. Axles 16 and 20 are respectively provided with the drive sprockets 26 and 30 which receive power from a motor drive, as described below with greater particularity.

Axle 16 is also provided with a pair of conveyor sprockets 32 at a downstream end of seaming apparatus 10. Conveyor sprockets 32 are disposed between side plates 12 and 14 and are spaced-apart from one another so as to receive conveyor chains 34. Axle 18, which is located at an upstream end of seaming apparatus 10, is likewise provided with a pair of conveyor sprockets such as conveyor sprocket 36, shown in FIG. 2. Sprockets 36 likewise receive chains 34 which thus form an endless loop.

Similarly, axle 20 is provided with a pair of conveyor sprockets 42 which are disposed between side plates 12 and 14. Again, conveyor sprockets 42 are in spaced-apart relation to one another and each support a chain 44 at a downstream location. Chain 44 is supported by means of conveyor sprockets, such as conveyor sprocket 46, which are identical to conveyor sprockets 32, 36 an 42 with conveyor sprockets 46 being located at an upstream location of seaming apparatus 10. Chains 44 again form an endless loop respectfully around conveyor sprockets 42 and 46.

From this description, it should be appreciated that chains 34 define a loop-shaped lower conveyor which, with reference to FIG. 2, can be seen to have a lower advance section 37, a lower downstream reverse section 38, a lower return section 39 and a lower upstream reverse section 40. Similarly, chains 44 define an upper conveyor which includes a loop-shaped upper conveyor advance section 47, an upper downstream reverse section 48, an upper return section 49 and an upper upstream reverse section 50. Accordingly, seaming apparatus 10 has an upstream end 52 and a downstream end 54 with the lower advance section of the lower conveyor and the upper advance section of the upper conveyor being in spaced-apart facing relation.

Chains 34 support a plurality of movable container supports which, with reference to the figures, is formed by container carriages 58. Similarly, chains 44 support a plurality of movable end closure supports; in this exemplary embodiment the end closures are described as "lids" with the supports referred to as lid carriages 60. It should be understood that the reference to an end closure as a "lid" and the support as a "lid support" is in no way intended to limit the invention to the seaming of lids only. The invention described herein can be used to put an end closure on a tubular sidewall to form the container body without departing from the scope of this disclosure. For convenience though, the invention is hereinafter described with reference to seaming a lid onto a container body.

Figure 4:
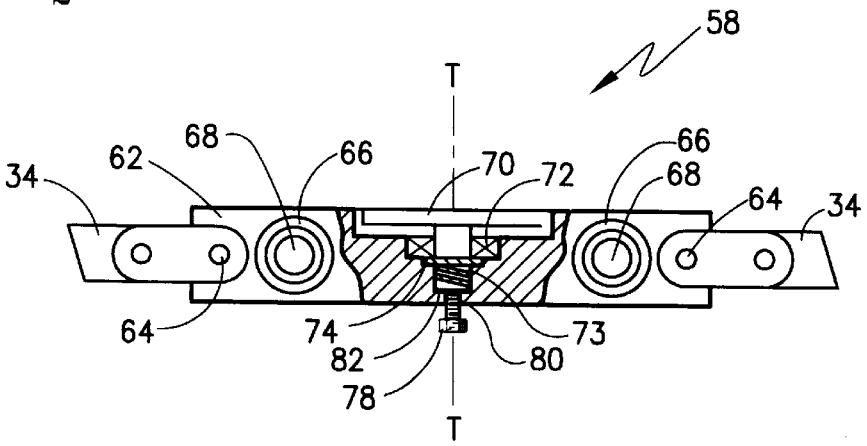
FIG. 4 is a side view, in partial cross-section, of the container carriage shown in FIG. 3.
Figure 3:
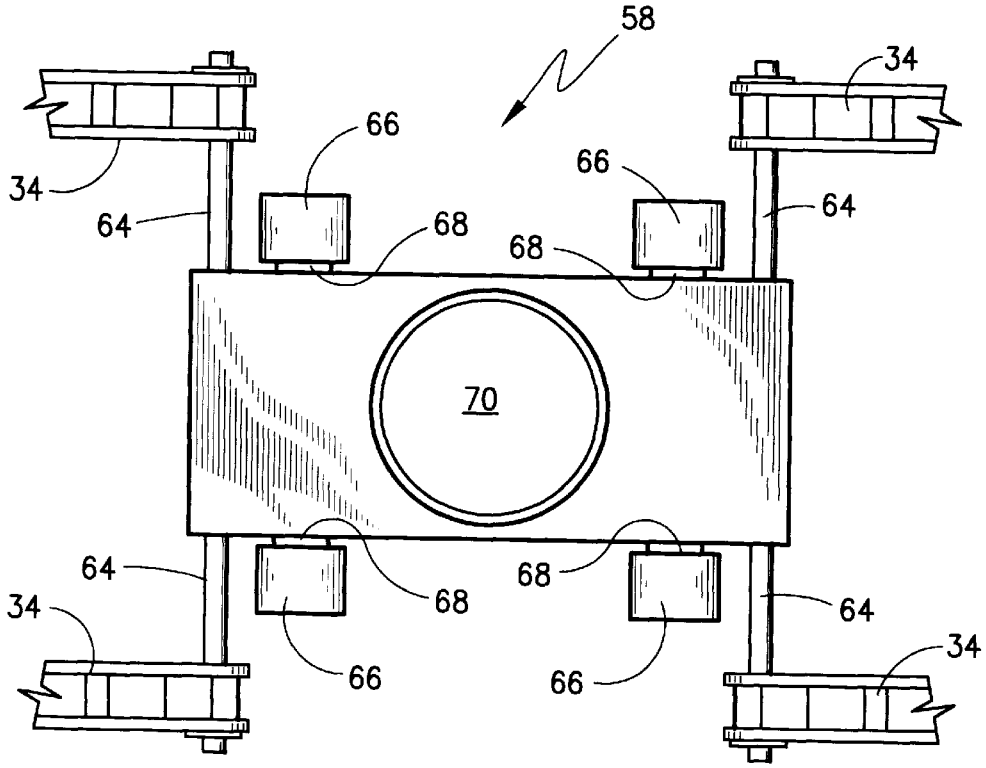
FIG. 3 is a top plan view of the container carriage according to the present invention shown attached to the drive chain therefor.

The structure of a representative container carriage 58 is best shown with reference to FIGS. 3 and 4. Likewise, the structure of a representative lid carriage 60 is best shown in reference to FIGS. 5 and 6. Turning to FIGS. 3 and 4, then, it may be seen that container carriage 58 includes a longitudinally extending bed 62 which is supported between opposite ones of chains 34 by means of shafts 64. Bed 62 rotatably supports a plurality of wheels 66 on axles 68 with suitable bearings (not shown) so that wheels 66 freely rotate relative to bed 62. Bed 62, wheels 66 and axle 68 are constructed of suitably strong tool-steel so that container carriage 58 may support the necessary loading force. Further, container carriage 58 includes a rotatable turntable 70 centrally disposed thereon and supported by means of a suitable bearing 72 so that it may freely rotate with respect to bed 62 along a turntable axis "T" that is perpendicular to bed 62. As is shown in FIG. 4, turntable 70 is spring biased outwardly of bed 62 by means of a biasing spring 73 which biases against flange 74 that prevents ejection of turntable 70 out of container carriage 58. An adjusting screw 78 extends through a bore 80 in bed 62 so as to engage an adjusting plate or washer 82 that bears against spring 73.

Figure 6:
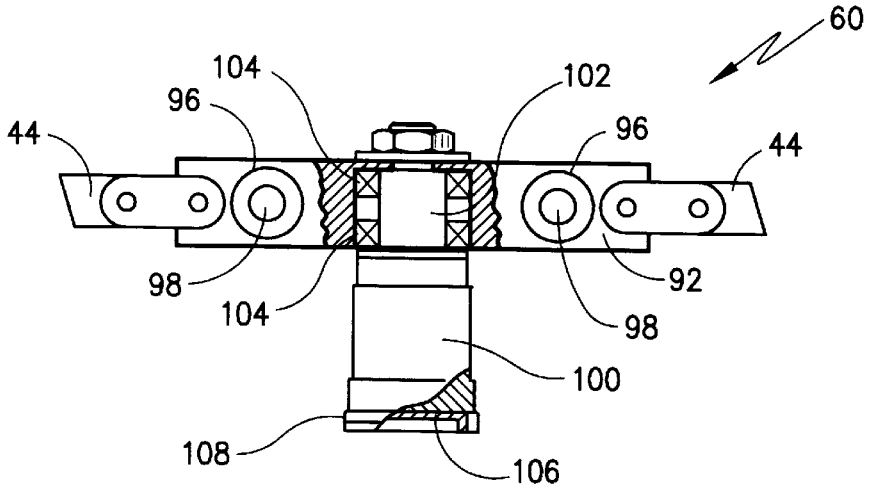
FIG. 6 is a side view in elevation, and partial cross-section, showing the end closure carriage and chuck of FIG. 5.
Figure 5:
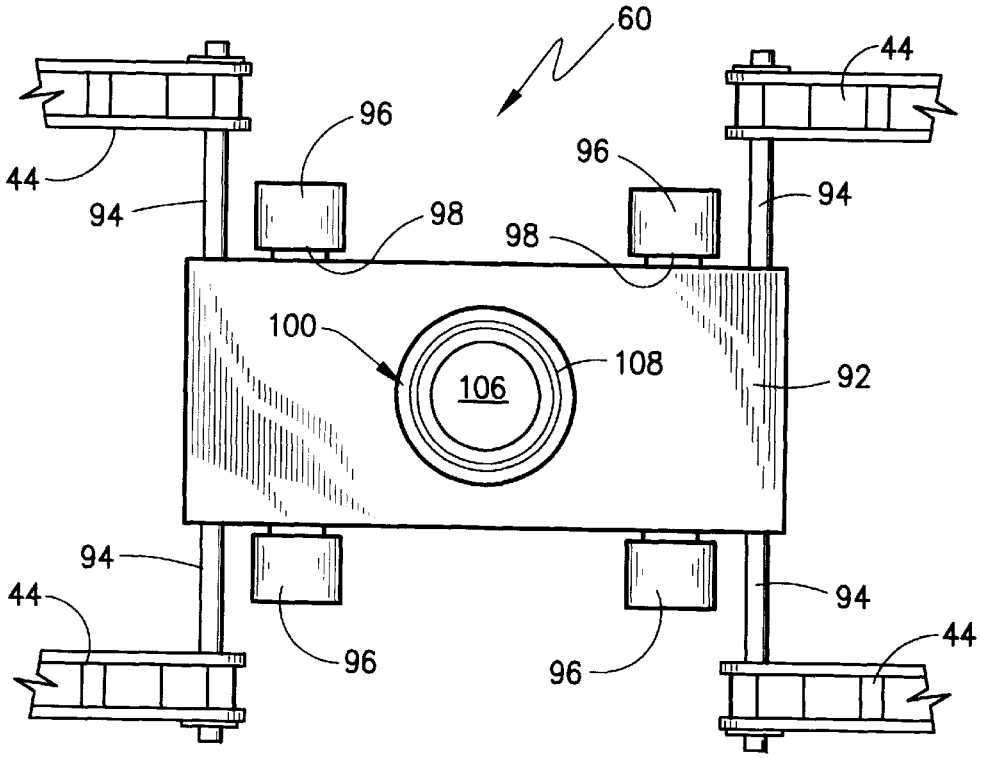
FIG. 5 is a bottom plan view of the end closure carriage and chuck according to the present invention shown attached to the drive chains therefor.
Figure 7:
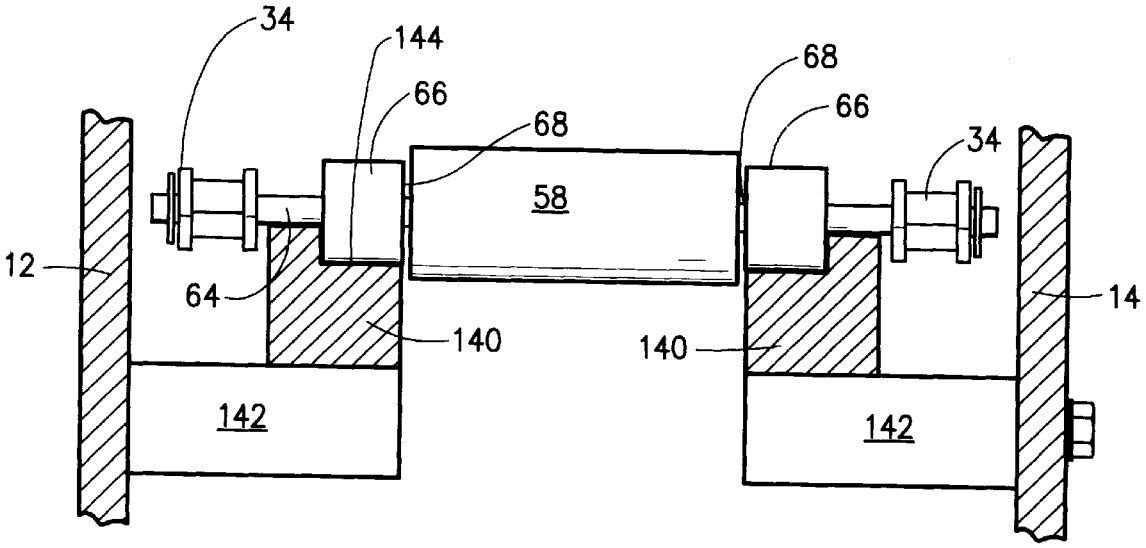
FIG. 7 is an end view in elevation showing the container carriage supported on the guide rail trackway according to the present invention.

With reference to FIGS. 5 and 6, it may be seen that much of the structure of lid carriage 60 is similar to that of container carriage 58, with notable exceptions. As is shown in these figures, lid carriage 60 includes a bed 92 which is supported between opposite chains 44 by means of rigid shafts 94. Bed 92 rotatably supports a plurality of wheels 96 on axles 98 which are mounted in suitable bearings so as to allow free rotation of wheels 96 relative to bed 92.

Bed 92 also rotatably supports a chuck 100 which is rotatably journaled on a shaft 102 by a pair of bearings 104 press-fit into bed 92 of lid carriage 60. Chuck 100 is provided with a resilient polymer ejection spring 106 of a type described in my U.S. Pat. No. 5,533,853. Moreover, chuck 100 includes a lower seaming profile 108 formed at a lower peripheral edge thereof.

From the above description, it should be appreciated that, when container carriage 58 and lid carriage 60 are respectively located on the advance section of each of the conveyors, they are conveyed from the upstream end 52 of seaming apparatus 10 to the downstream end 54 thereof in confronting relation to one another. To this end, and again with reference to FIGS. 1 and 2, it may be seen that container carriage 58 is operative to support a container body, such as container body 110 with a bottom 112 of container body 110 being disposed on turntable 70. Similarly, chuck 100, and thus lid carriage 60, is operative to support an unseamed lid 120. Unseamed lids 120 are placed on chuck 100 when lid carriage 60 is being transported on the upper return section.

With reference to FIG. 2, it may be seen that an unseamed lid 120 may be placed on chuck 100 in an inverted manner by any suitable lid feed (not shown in this figure). As lid carriage 60 is transported around the upper upstream reverse section 50, unseamed lid 120 becomes correctly oriented so as to engage an upper or top edge 114 of container body 110. In order to prevent dislodgement of unseamed lid 120, a suitable arcuate guide rail 116 is provided at the upstream end of seaming apparatus 10. Guide rail 116 is preferably semi-circular and includes a T-shaped channel 118 that is sized and adapted to slidably receive an unseamed lid 120 as it is translated around the upper upstream reverse portion of the upper conveyor.

It should now be appreciated that a pair of carriages, including a container carriage and a lid carriage move into facing or confronting relationship with each other as they are transported around the upper and lower carriages. As such a pair of carriages move into position at the upstream end of seaming apparatus 10, an unseamed lid 120 is placed on the top edge 114 of a container body 110 to define an unseamed set. Moreover, it should be understood that container body 110 at this point is typically filled with the product to be packaged. Moreover, it should be understood that the container carriage 58 and the lid carriage 60 are spaced-apart from one another so as to accommodate the combined dimension of the height of container body 110, the thickness of unseamed lid 120 and the height of chuck 100. It should be understood that the spring bias of the turntable 70 imparts a predetermined column load to the container body and unseamed lid. Preferably, the set column load is about 20 to 30 pounds as opposed to a column load on the order of 100–300 pounds in prior art apparatus. Spring 73 should be selected to accomplish this load upon compression of about 0.020 inch.

Figure 8:
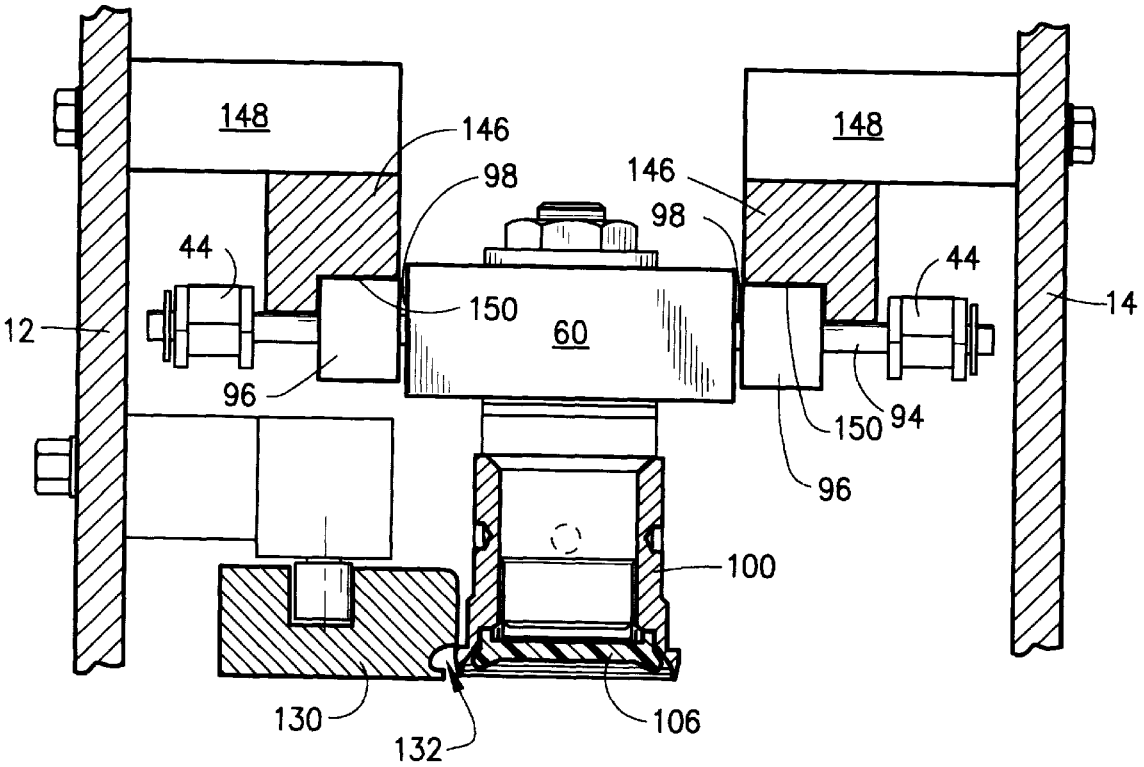
FIG. 8 is an end view in elevation showing the end closure carriage and chuck supported on the guide rail trackway according to the present invention and showing the chuck interaction with the seaming element according to the first exemplary embodiment of the present invention.

In order to secure a lid 120 onto a container body 110 as a seamed container, it is necessary to crimp the peripheral edge 122 of lid 120 and the top edge 114 of container body 110 together. This is accomplished by the cooperation between chuck 100 and a seaming element 130 best shown in FIGS. 1, 2 and 8. Here it should be appreciated that seaming element 130 extends generally linearly and longitudinally in a direction parallel to the transport direction "A" and is located laterally of the container body 110 as it moves along the advance section of the lower conveyor. Seaming element 130 includes a linear seaming groove 132 which is configured to engage the peripheral edge 122 of the lid 120 and the top edge 114 of container body 110 and progressively form those edges to seam them, one to the other. Such engagement causes rotation of chuck 100 and container body 110 with this rotation being permitted by the rotational mounting of chuck 100 to bed 92 and the rotational mounting of turntable 70 to bed 62. Furthermore, since the seaming takes place during the linear transport of container body 110 and lid 120, a lower loading force can be applied between lid 120 and container body 110.

Notwithstanding that a lower column force may be employed, it is still necessary to rigidly and precisely retain lid 120 on top edge 114 of container body 110 during the seaming operation. With reference to FIGS. 1, 2, 7 and 8, it may be seen that this is accomplished by the interaction of carriages 58 and 60 with support trackways. This is depicted in these figures, a first trackway is formed by a pair of opposed first rails 140 that are rigidly mounted to relative to side plates 12 and 14 by mounting blocks 142. First rails 140 include a planar race 144 on which wheels 66 of container carriage 58 ride during advancement of container carriage 58, at least in a portion thereof adjacent seaming element 130. Similarly, a second trackway is formed by a pair of second rails 146 that are rigidly mounted to side plates 12 and 14 by mounting blocks 148. Second rails 146 each include a second race 150 on which wheels 96 ride as lid carriage 60 is translated in the advance direction, at least adjacent seaming element 130. Thus, it should be understood, that rails 140 and 146 prevent separation of container carriage 58 and lid carriage 60 during the seaming operation. To this end, as noted above, carriage 58 and 60 are formed of suitably strong steel or other material.

Figure 9:
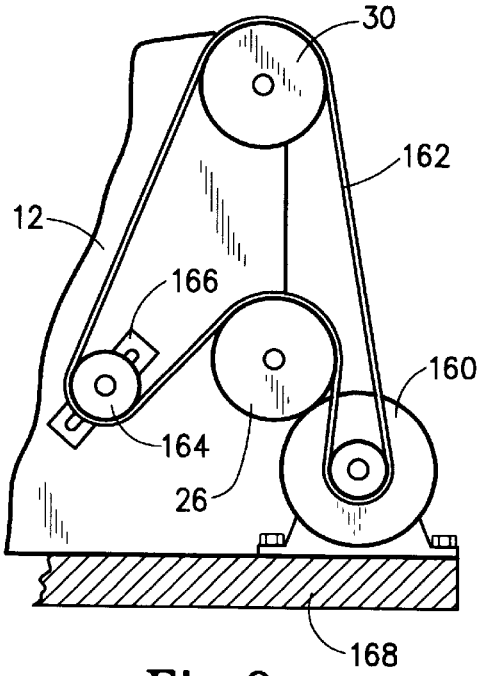
FIG. 9 is a side view in elevation showing the motor drive according to the present invention.

Moreover, it may now be appreciated more fully that the column load between container body 110 and lid 120 is provided by the interaction of spring 73 and ejector spring 106. This column loading force may be adjusted by screw 78 which can pre-load spring 74 a desired amount. Additionally, it should now be understood that it is important that each of the conveyors formed by chains 34 and 44 be driven at the same rate of velocity so that container carriage 58 and lid carriage 60 move at the same rate of speed in the transport direction while being advanced from the upstream end of seaming apparatus 10 to the downstream end thereof. To this end, as is shown in FIG. 9, a suitable drive motor 160 includes a continuous drive chain 162 which extends around drive sprockets 26 and 30. In order to adjust the tension of drive chain 162, an idler sprocket 164 slidably and adjustably mounted to side plate 12 as is known in the art. Drive motor 160 may be support by frame bed 168 at any suitable location.

Figure 10:
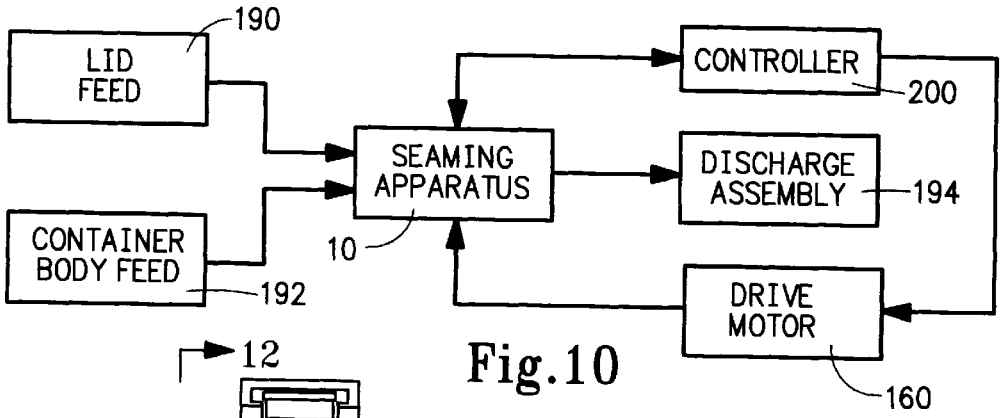
FIG. 10 is a diagrammatic view showing the seaming apparatus according to the present invention.

Turning briefly to FIG. 10, it may be seen that the seaming system according to the present invention includes the seaming apparatus such as that described above along with any suitable lid feed 190. Seaming apparatus 110 is driven by drive motor 160 and any suitable discharge assembly 194, as is known in the art, is operative to receive the seamed containers at the downstream end of seaming apparatus 10, again as is known in the art. Operation of the seaming apparatus 10 may be controlled by any suitable controller 200 and associated sensors, again as is known in the art.

Figure 11:
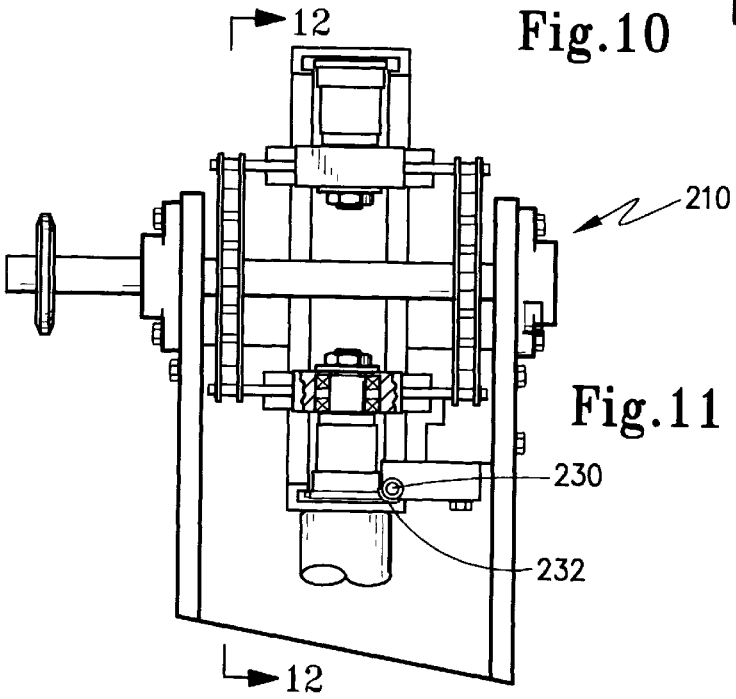
FIG. 11 is an end view in elevation showing the end closure conveyor, end closure carriage, chuck assembly and seaming element according to a second exemplary embodiment of the present invention.
Figure 12:
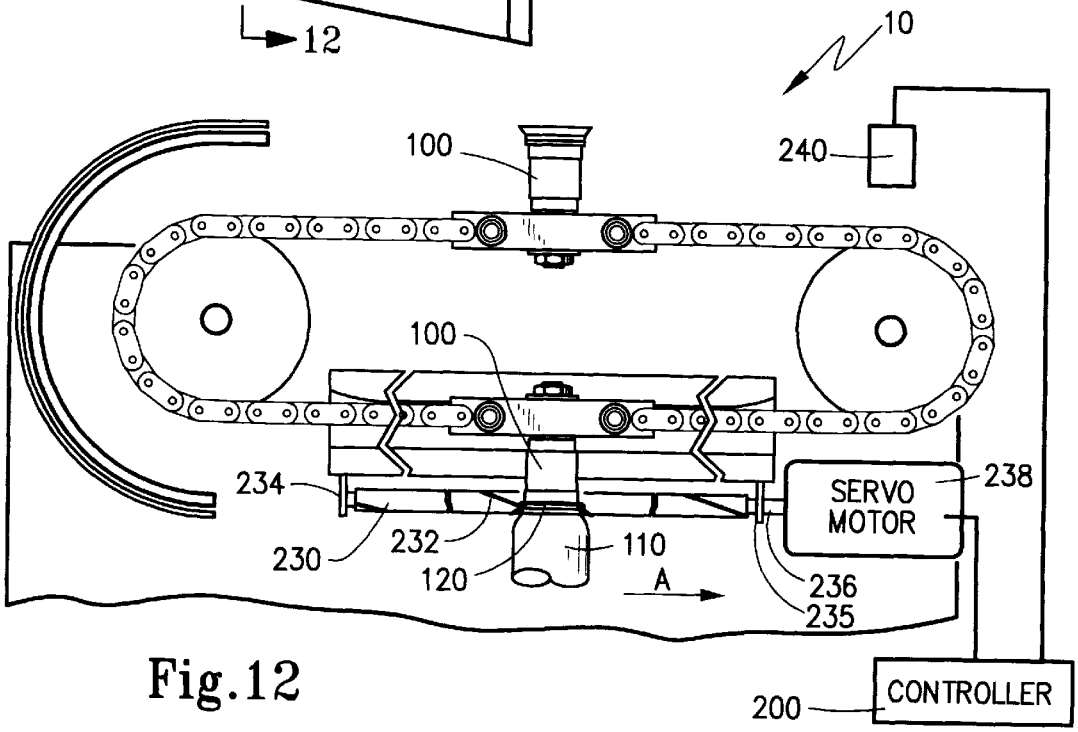
FIG. 12 is a cross-sectional view taken about lines 12—12 of FIG. 11.

With reference to FIGS. 11 and 12, a second exemplary embodiment of the present invention is shown. As is shown in FIGS. 11 and 12, seaming apparatus 210 is identical to seaming apparatus 10 with the exception that the seaming element 230 is mechanically driven in this second embodiment. Accordingly, the similar structure of seaming apparatus 210 is not repeated.

In seaming apparatus 210, seaming element 230 is in the form of an elongated cylinder which extends linearly along the transport direction "A" and includes a seaming groove 232 which is helically disposed on the cylindrical side surface thereof. Seaming element 230 is rotatably journaled by suitable bearings 234 and 236 at the upstream and downstream ends thereof so as to be able to be rotated as a container body 110 and a lid 120 is advanced therethrough. Rotation of seaming element 230 is provided by means of a drive shaft 236 that is connected to a servo motor 238. A sensor 240 is provided to monitor the position of the lid carriage so that controller 200 can properly actuate servo motor 238 at a proper angular velocity corresponding to the transport velocity of container 110 and lid 120 so that seaming groove 232 properly engages chuck 100 during the seaming operation.

From the foregoing, it should be appreciated that a container body and lid may be linearly advanced through the seaming apparatus 10 or 210 with an unsealed set of a container body and a lid being progressively seamed together to form a seamed container that is then discharged at the downstream end of the seaming apparatus. Any desired number of container carriages and lid carriages may be used, and it should be appreciated by the ordinarily skilled person in this art that it is not necessary that each of the conveyors be provided with the identical number of carriages. All that is important is that the carriages be equally spaced around the conveyor so that a container carriage will always confront a lid carriage as the carriages are advanced in the advance sections of the two conveyors. To this end, the length of each conveyor need to be an intraval multiple of the distance between the conveyors.

Also, from the foregoing, it should be appreciated that the present invention includes a method of seaming a lid on a container. This method comprises a first step of placing an end closure on an end edge of a container as an unseamed set and engaging the peripheral edge of the end closure and the end edge of the container body with a chuck. Next, the method includes the step of advancing the unseamed set in a linear transport direction from an upstream end toward a downstream end past a linear seaming element that has a longitudinally extending seaming groove disposed thereon such that the peripheral edge of the end closure and the end edge of the container body are engaged by the chuck and forming groove. Next, the method includes the step of allowing rotation of the unseamed set as it transports linear past the seaming element such that the container and the seaming groove act cooperatively to seam the end closure on the container as a seamed set. Finally, the method includes the step of discharging the seamed container at the downstream end. This method may also include the step of rotatably driving the seaming element during the interval of time that it engages the peripheral edge of the end closure and the end edge of the container body in a synchronous manner so as to rotate the seaming groove thereagainst.

Accordingly, the present invention has been described with some degree of particularity directed to the exemplary embodiments of the present invention. It should be appreciated, though, that the present invention is defined by the following claims construed in light of the prior art so that modifications or changes may be made to the exemplary embodiments of the present invention without departing from the inventive concepts contained herein.

I claim:

1. A seamer apparatus adapted to receive a container body and an end closure therefor at an upstream end and operative to seam a peripheral edge of said end closure onto a first end edge of said container body to form a seamed container as said end closure and said container body move from the upstream end to a downstream end comprising:

(a) a movable container support including a freely rotatable turntable operative to rotatably support said container body;

(b) a movable end closure support including a freely rotatable chuck operative to engage and support said end closure on the first end edge of said container body, said end closure and said container body defining an unseamed set;

(c) a transport including a pair of loop conveyors each having an advance section, a downstream reverse section, a return section and an upstream reverse section, said advance sections being in opposed facing relation, a first conveyor being operative to transport said container support in a transport direction that is linear along the advance section thereof from the upstream end toward the downstream end and a second conveyor being operative to transport said end closure support in the transport direction;

(d) a seaming element having a seaming groove formed thereon and operative in cooperation with said chuck to engage the peripheral edge of said end closure and the first end edge of said container body and rotate said unseamed set as it is transported therealong, said seaming groove and said chuck configured to seam the first end edge and the peripheral edge together to form said seamed container as said unseamed set is advanced linearly along said seaming element; and (e) a conveyor drive operative to drive said first and second conveyors.

2. A seamer apparatus according claim 1 wherein the end closure is placed on said chuck when said lid support travels along the return section of said second conveyor, and including a guide operative to retain the end closure on said chuck while said end closure support travels along the upstream reverse section of said second conveyor.

3. A seamer apparatus according to claim 2 wherein said guide is an arcuate member having at least 180° of arc.

4. A seamer apparatus according to claim 2 wherein said guide has a T-shaped channel formed therein, said T-shaped channel being sized and adapted to slideably receive and support an unseamed end closure.

5. A seamer apparatus according to claim 1 wherein said first conveyor includes a pair of first chains and said second conveyor includes a pair of second chains, said container support being mounted between and supported by said first chains and said end closure support being mounted between and supported by said second chains.

6. A seamer apparatus according to claim 1 including linkage associated with said first and second conveyors and operative to drive said first and second conveyors synchronously such that said container support and said end closure support are in facing relation during travel along respective advance sections of said first and second conveyors.

7. A seamer apparatus according to claim 1 wherein said container support is in the form of a first carriage including a first bed and a plurality of first wheels disposed thereon and wherein said end closure support is in the form of a second carriage including a second bed and a plurality of second wheels disposed thereon, and including a first trackway for engaging said first wheels and a second trackway for engaging said second wheels such that said first and second beds are supported against movement away from one another during travel of the unseamed set along said seaming element.

8. A seamer apparatus according to claim 7 wherein said first trackway includes a pair of opposed first rails each having a first race formed therein and wherein said second trackway includes a pair of opposed second rails each having a second race formed therein.

9. A seamer apparatus according to claim 1 wherein said turntable is resiliently biased relative to said container support.

10. A seamer apparatus according to claim 1 wherein the seaming groove is linear.

11. A seamer apparatus according to claim 1 wherein said seaming element is cylindrical in shape and the seaming groove is helical, and including a seaming element drive operative to rotate said seaming element.

12. A seamer apparatus according to claim 1 including a plurality of movable container supports on said first conveyor and a plurality of movable closure supports on said second conveyor, said conveyor drive operative to advance each of said container supports and each of said closure supports cyclically past said seaming element.

13. A seamer apparatus according to claim 12 including a container body feed assembly operative to sequentially place container bodies on said container support as they are transported around said first conveyor and an end closure feed assembly operative to sequentially place unseamed end closures on said end closure supports as they are transported around said second conveyor.

14. A seamer apparatus according to claim 13 including a container take-up assembly operative to remove seamed containers from said transport.

15. A seamer apparatus adapted to receive a container body and a lid therefor at an upstream end and operative to seam a peripheral edge of said lid onto a top edge of said container body to form a seamed container as said lid and said container body move from the upstream end to a downstream end, said container body having a bottom opposite the top edge and a surrounding sidewall extending therebetween, comprising:

(a) a lower conveyor including a pair of spaced-apart lower chains, said lower conveyor having a lower advance section, a lower downstream reverse section, a lower return section and a lower upstream reverse section;

(b) an upper conveyor including a pair of spaced-apart upper chains, conveyor having a upper advance section, an upper downstream reverse section, an upper return section and an upper upstream reverse section, said upper and lower advance sections being in spaced-apart facing relation;

(c) a container carriage disposed on said lower conveyor and extending between said lower chains, said container carriage including a rotatable turntable operative to rotatably support said container body during transport along the lower advance section from an upstream end to a downstream end;

(d) a lid carriage disposed on said upper conveyor and extending between said upper chains, said lid carriage including a chuck rotatably disposed thereon and operative to engage a lid during transport along the upper advance section from the upstream end to the downstream end, said lid carriage and said container carriage positioned and advanced in opposed relation to one another such that the lid is placed on top of said container body and retained thereon with a peripheral edge of said lid engaging a top edge of said container body during transport from the upstream end to the downstream end;

(e) an elongated seaming element having a longitudinal axis substantially parallel to the transport direction, said seaming element having a longitudinally extending seaming groove formed thereon and operative in cooperation with said chuck to engage the peripheral edge of said lid and the top edge of said container body, said seaming groove and said chuck configured to seam the top edge and the peripheral edge together to form said seamed container as said unseamed set is advanced linearly along said seaming element.

16. A seamer apparatus according to claim 15 wherein said container carriage includes a first bed and a plurality of first wheels rotatably journaled thereon and wherein said lid carriage includes a second bed and plurality of second wheels rotatably journaled thereon, and including a first trackway for engaging said first wheels and a second trackway for engaging said second wheels such that said first and second beds are supported against movement away from one another during travel of the unseamed set along said seaming element.

17. A seamer apparatus according to claim 16 wherein said first trackway includes a pair of opposed first rails each having a wheel receiving channels formed therein and wherein said second trackway includes a pair of opposed second rails each having a wheel receiving channel formed therein.

18. A seamer apparatus according to claim 15 wherein said turntable is resiliently biased outwardly of said bed.

19. A seamer apparatus according to claim 15 wherein the seaming groove is linear.

20. A seamer apparatus according to claim 15 wherein said seaming element is cylindrical in shape and the seaming groove is helical, and including a seaming element drive operative to rotate said seaming element.

21. A method of seaming an end closure on a container comprising the steps of:

(a) placing an end closure on a first end edge of a container body as an unseamed set;

(b) engaging the first end edge of said container and a peripheral edge of said end closure with a chuck;

(c) rigidly constraining said end closure and said container body against movement away from one another;

(d) rotatably supporting the unseamed set while constraining end closure and said container body advancing said unseamed set in a linear transport direction from an upstream end toward a downstream end past a linear seaming element that has a longitudinally extending seaming groove disposed thereon such that the peripheral edge and the first end edge are engaged by chuck and seaming groove;

(e) allowing free rotation of said unseamed set as it transports linearly past said seaming element such that chuck and seaming groove act to rotate said unseamed set solely as a result of the linear movement of said unseamed set therepast and thereby seam said end closure onto said container body as a seamed container; and (f) discharging said seamed container at a downstream location.

22. A method of seaming an end closure on a container comprising the steps of:

(a) advancing a container body in an upright orientation;

(b) placing an end closure on said chuck element while said chuck element is in an inverted orientation a first end edge of a container body as an unseamed set;

(c) advancing a freely rotatable chuck element from an inverted orientation to a non-inverted orientation while said end closure is disposed thereon and supporting said end closure during movement of said chuck element from the inverted orientation to the non-inverted orientation thereby to place said end closure on a first end edge of said container body as an unseamed set;

(d) rigidly constraining said end closure and said container body of said unseamed set against movement away from one another;

(e) rotatably supporting the unseamed set while constraining end closure and said container body while advancing said unseamed set in a linear transport direction from an upstream end toward a downstream end past a linear seaming element that has a longitudinally extending seaming groove disposed thereon such that the peripheral edge and the first end edge are engaged by chuck and seaming groove;

(f) allowing rotation of said unseamed set as it transports linearly past said seaming element such that chuck and seaming groove seam said end closure onto said container body as a seamed container; and (g) discharging said seamed container at a downstream location.

* * * * *